United States Patent [19]

Cooper et al.

[11] 3,958,361

[45] May 25, 1976

[54] TRACK SEGMENT WITH BRAKING ELEMENTS WHICH RETAIN VEHICLE VERTICALLY DURING BRAKING

[75] Inventors: Julius Cooper, New Hyde Park; Burt Ensmann, Flushing; Edwin Nielsen, Oceanside; Vincent Carella, Queens Village, all of N.Y.

[73] Assignee: Ideal Toy Corporation, Hollis, N.Y.

[22] Filed: Oct. 17, 1974

[21] Appl. No.: 515,734

Related U.S. Application Data

[62] Division of Ser. No. 126,818, March 22, 1971, Pat. No. 3,860,237.

[52] U.S. Cl. ..... 46/1 K; 46/202; 46/206

[51] Int. Cl.[2] ..... A63H 18/00

[58] Field of Search ..... 46/1 K, 201, 202, 216; 273/86 R

[56] References Cited

UNITED STATES PATENTS

| | | | |
|---|---|---|---|
| 3,648,407 | 3/1972 | Pressman | 46/216 X |
| 3,674,269 | 7/1972 | Cooper et al. | 273/86 R |
| 3,712,615 | 1/1973 | Staats et al. | 273/86 R |

FOREIGN PATENTS OR APPLICATIONS

| | | | |
|---|---|---|---|
| 527,520 | 5/1955 | Italy | 273/86 R |

*Primary Examiner*—F. Barry Shay
*Attorney, Agent, or Firm*—Richard M. Rabkin

[57] ABSTRACT

A toy vehicle racing game is described utilizing a continuous, unguided vehicle race track with steeply banked curves and straight, flat horizontal track sections. The width of the unguided roadbed surface is selected so that vehicles may pass one another. A player-controlled chicane is employed in the path of the high speed vehicles. The chicane includes normally active slow-down devices which the players attempt to disable manually just at the time that their vehicle is about to pass over the chicane. Vehicles which are able to pass the chicane without a speed reduction travel over the high end of the steeply banked curves to pass other vehicles which were slowed down. A vehicle diverter is employed to segregate the vehicles on a right-left basis before traversing the chicane. The vehicle diverter employs track guides in dovetailed relationship to guide the vehicles and prevent their bouncing off the track as they engage the track guides at high speeds. The toy vehicles are spring-driven and provided with travel range limits to require a number of spring rewinds before completing a race of a desired number of laps around the track.

6 Claims, 19 Drawing Figures

TRACK SEGMENT WITH BRAKING ELEMENTS WHICH RETAIN VEHICLE VERTICALLY DURING BRAKING

This is a division of application Ser. No. 126,818, filed Mar. 21, 1971, now U.S. Pat. No. 3,860,237.

BACKGROUND OF THE INVENTION

This invention relates to a toy vehicle racing game. More specifically it relates to a toy vehicle track and related devices for an exciting toy vehicle racing game.

Toy vehicle racng games are well known and may take a variety of forms, such as the type which employs a slotted, car-engaging race track. A racing game generally related to the game of this invention is disclosed in the U.S. patent to Barnum U.S. Pat. No. 1,703,378. The Barnum patent discloses a continuous race track having a single race surface over which a plurality of self-propelled, spring-driven objects are raced. The Barnum track is of the open, unguided type, as distinguished from the slot-car games wherein the toy vehicles race along slots formed in track sections. The Barnum race track is laid out in a continuous manner, such as a closed single loop, with curves and straight track sections. All of the track sections are inwardly inclined so that the racing objects normally gravitate to the inner edge of the track. Passing between racing objects is achieved by devices that periodically increase the speed of the objects so that the faster object may ride around the slower object even while the slanted track maintains the passing objects in contact with each other.

SUMMARY OF THE INVENTION

In a toy vehicle racing game in accordance with the invention, a continuous toy vehicle race track is provided with an unguided racing surface of sufficient width to enable toy vehicles to pass one another. The track is formed of generally horizontal and flat track sections, plus curved track sections coupled thereto, which are steeply banked. When two vehicles traveling at different speeds move through the curved section of the track, they are separated by the effects of centrifugal force which tends to urge the vehicles outwardly, with the faster moving vehicle subjected to a greater centrifugal force and thus being urged radially outwardly along the track further than the slower moving vehicle. Thus, a faster vehicle may pass a slower vehicle on the curves by virtue of the higher bank position of the faster vehicle. Toy vehicle speed variations are obtained by player-controlled chicanes. The chicanes, or race track obstacles, are formed of vehicle slow-down devices that are located in the path of the racing vehicles. The slow-down devices are momentarily actuated by the player to influence the vehicle speed, and depend on the skill of the player as exercised by his timely actuation of a slow-down device.

An advantageous game feature utilizes a maximum limit of the number of laps that a vehicle can travel. This feature is obtained as described in connection with a preferred embodiment, by limiting the amount of drive energy stored in a wound-up spring.

As described with respect to the preferred embodiment, the chicane utilizes slow-down devices which are normally maintained in a vehicle-engaging position. An actuator is provided to momentarily disable the slow-down device to allow a toy vehicle to pass the chicane without a speed reduction. The time during which the slow-down device is disabled is limited by the actuator to a short duration, and only the start of the disabling period is under the control of the player. The player must therefore time his actuation carefully with the arrival of the toy vehicle. The players each control slow-down devices which are segregated to receive correspondingly segregated vehicles. Since the track is unguided, a vehicle diverter is employed to segregate the vehicles and direct them towards the proper slow-down device. The toy vehicles are provided with means which are located to enable the diverter to properly segregate the vehicles.

An advantageous feature of track devices in accordance with the invention resides in the use of retaining guide structures located in the roadbed of the track to guide the vehicles. The retaining guide structures engage the vehicle-mounted diverting means in dovetail relationship, both to provide the guidance, and to prevent the vehicles from bouncing off the track.

The toy vehicles employed with the racing game in accordance with this invention are powered by a spring drive that provides a substantially constant output torque. A gear train is employed to couple the spring drive to the wheels of the vehicle and is selected to provide a low starting torque for constant acceleration over a long time period. Consequently, a vehicle slowed down by the chicane slowly regains its normal speed, to permit vehicle passing to occur.

BREIF DESCRIPTION OF DRAWINGS

Figures 9, 9A, 10, 11, 12, 13, 14:
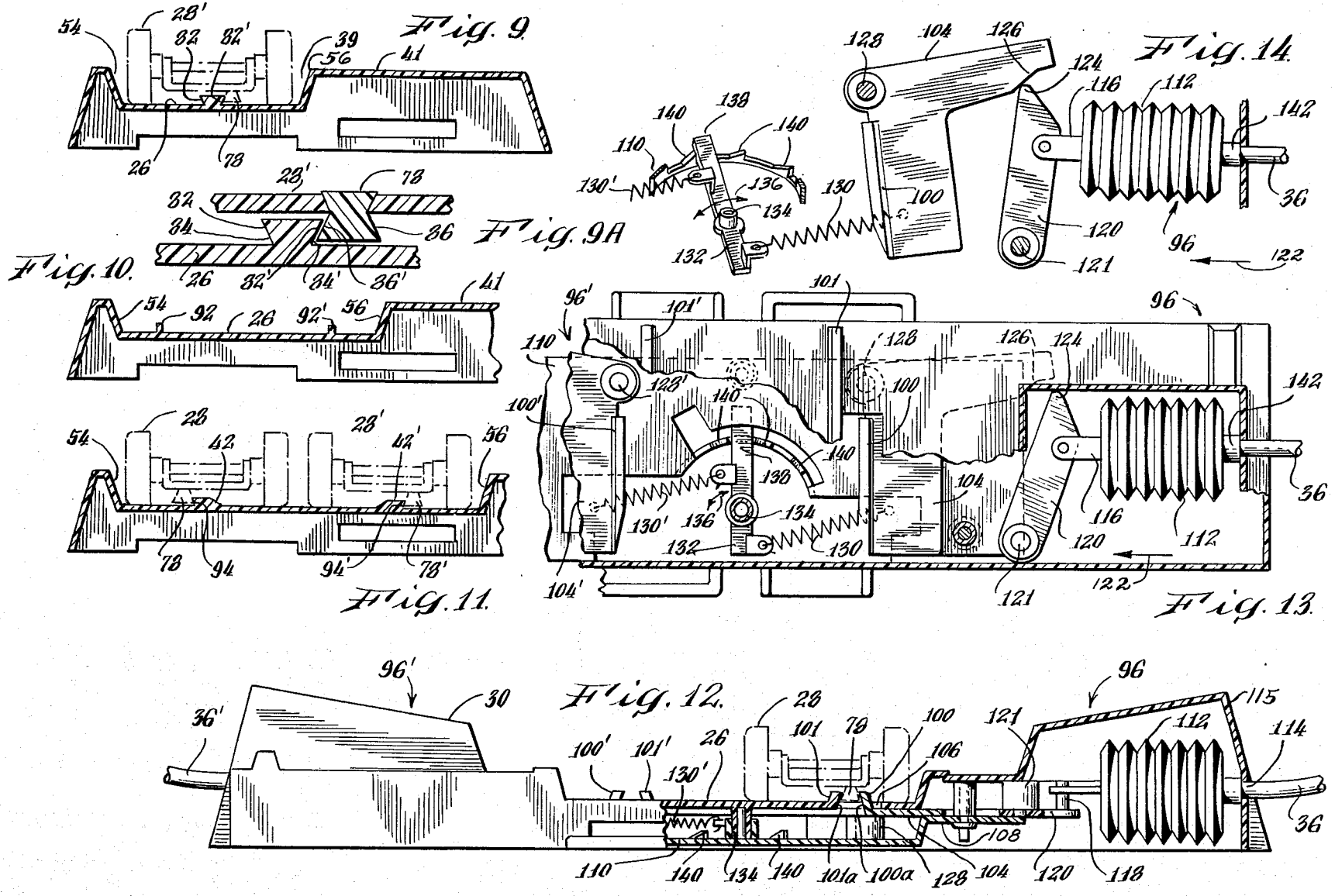
FIG. 9 is an enlarged section view of a diverter track section and is taken along the line 9—9 in FIG. 7.

FIG. 9*a* is an enlarged view of a portion of FIG. 9.

Figures 7, 8:
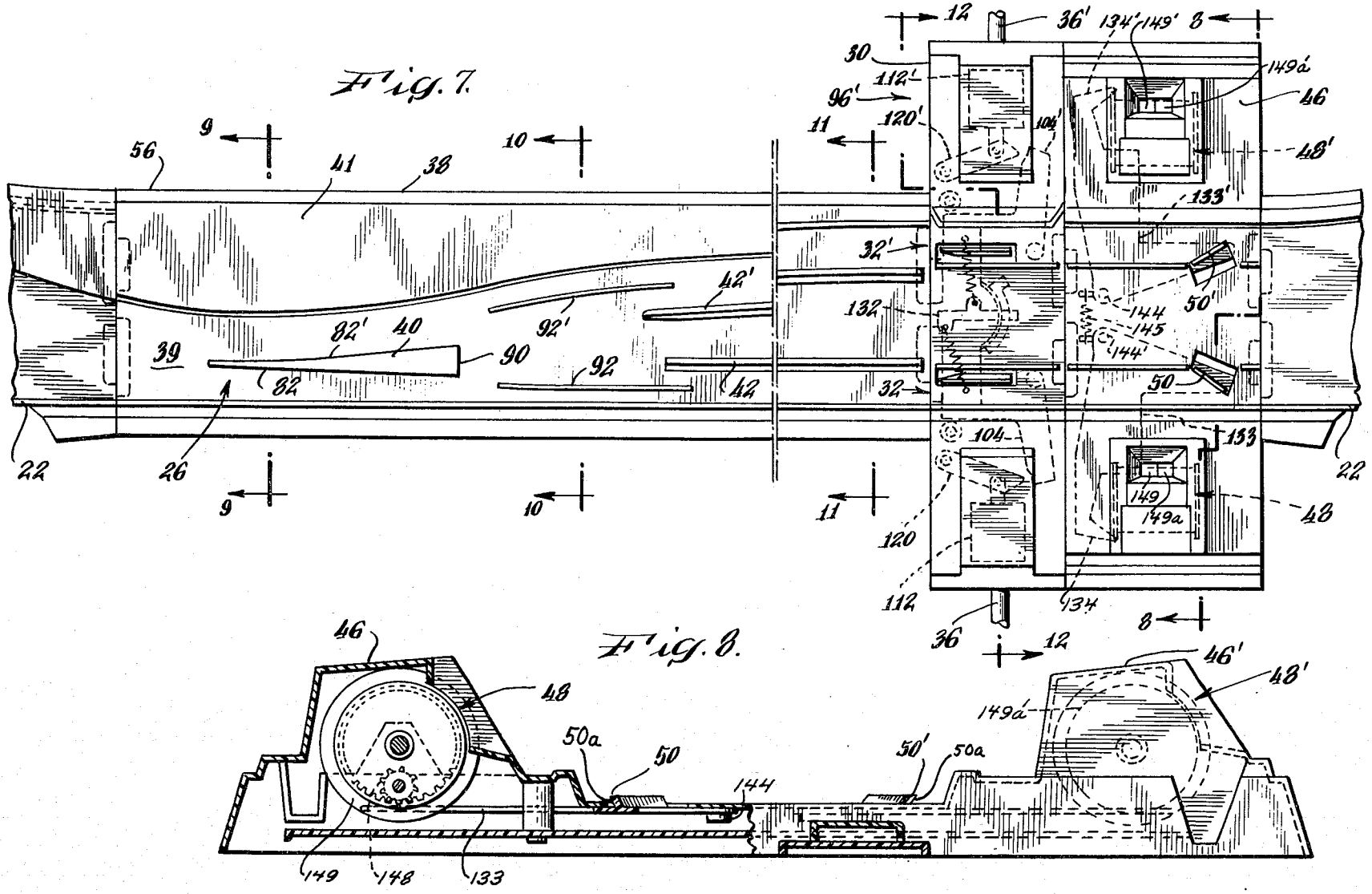
FIG. 7 is an enlarged broken top plan view of a chicane employed with the track shown in FIG. 1.
FIG. 8 is a section view of a lap counter employed with the track of FIG. 1, and is taken along the line 8—8 in FIG. 7.

FIG. 10 is an enlarged partial section view of the diverter track section taken along the line 10—10 in FIG. 7.

FIG. 11 is an enlarged partial section view of the diverter track section taken along the line 11—11 in FIG. 7.

Figure 1:
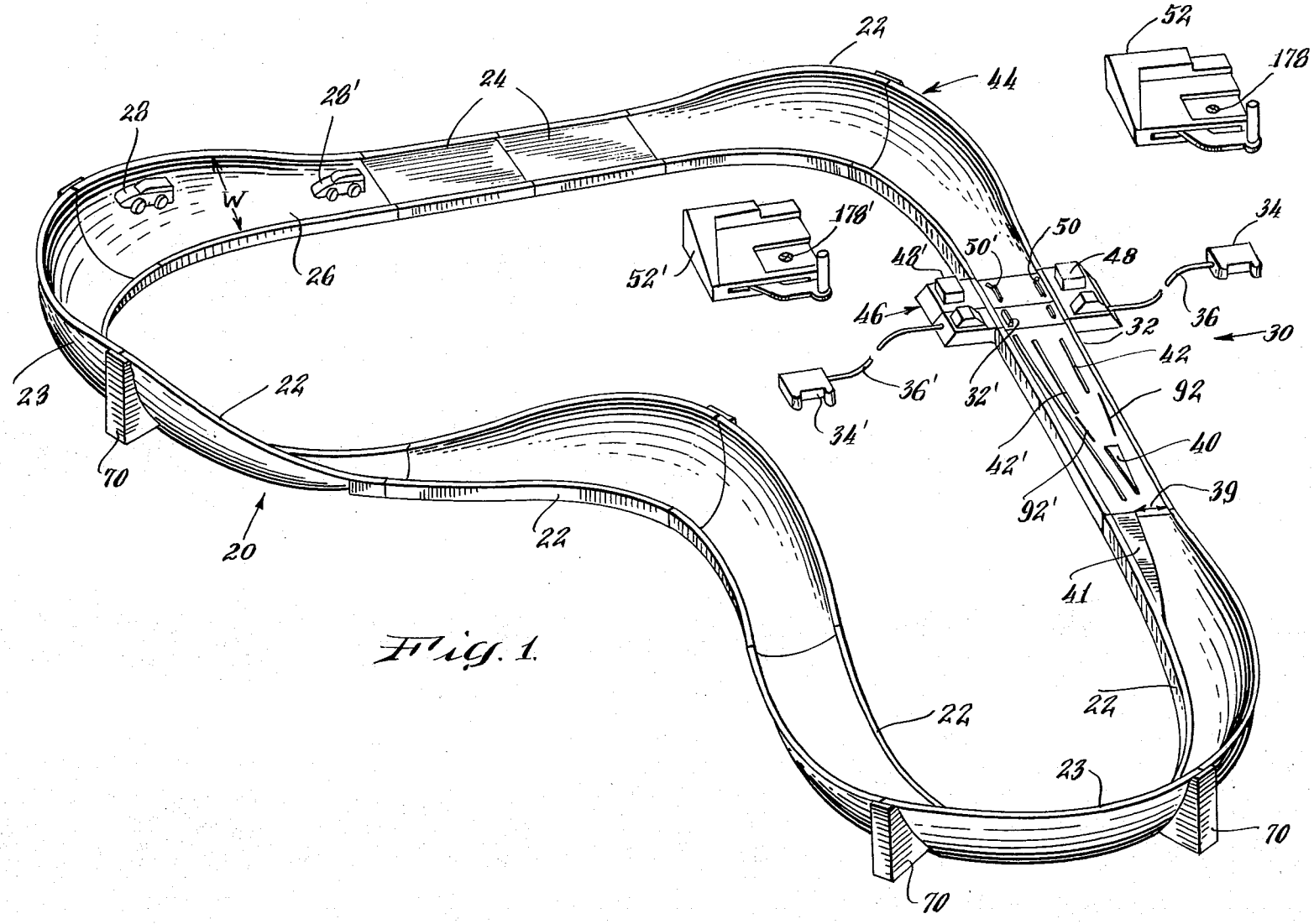
FIG. 1 is a perspective view of a toy vehicle race track in accordance with the invention.

FIG. 12 is an enlarged partial section view of a chicane employed with the track of FIG. 1 and is taken along the line 12—12 in FIG. 7.

FIG. 13 is an enlarged partial top plan view of the chicane in FIG. 12, with an outer housing broken away to reveal actuator elements.

FIG. 14 is a top plan view of an actuator mechanism employed with the chicane of FIG. 12, with the component elements illustrated in an actuated position.

Figure 15:
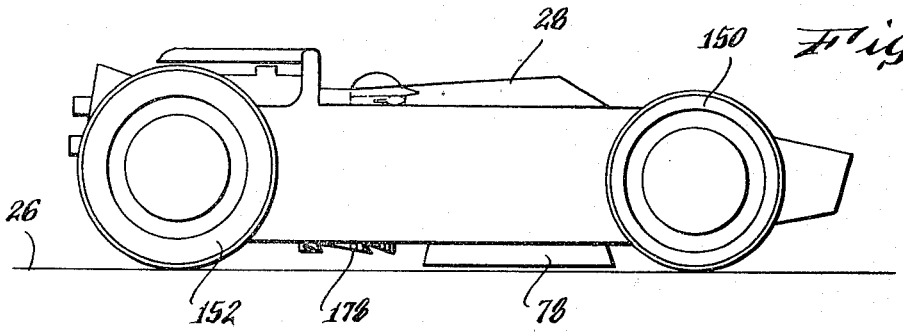

FIG. 15 is a side view in elevation, of a toy vehicle racer employed with a vehicle race track in accordance with the invention.

Figure 16:
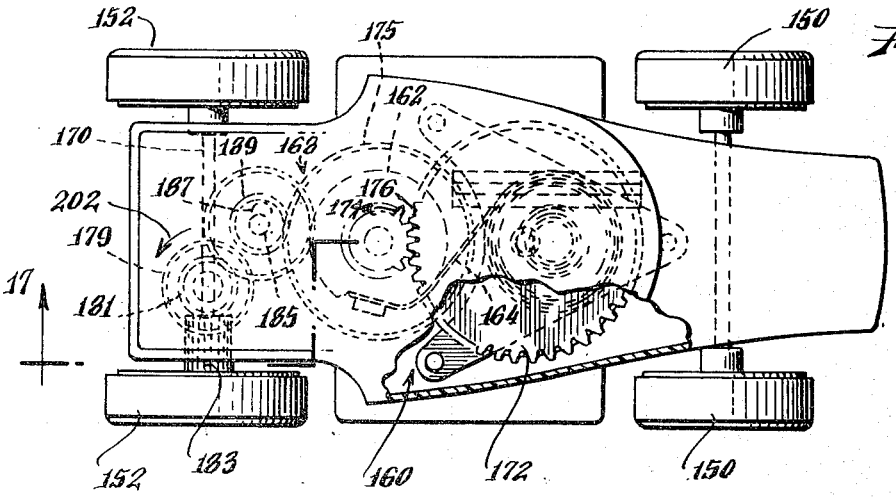

FIG. 16 is a top plan, partially broken-away view of the vehicle in FIG. 15.

Figure 17:
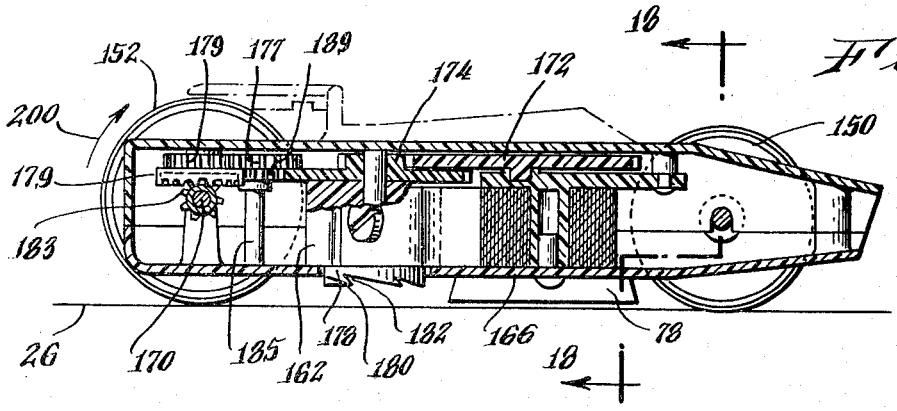

FIG. 17 is a section view of the toy vehicle racer, and is taken along the line 17—17 in FIG. 16.

Figure 18:
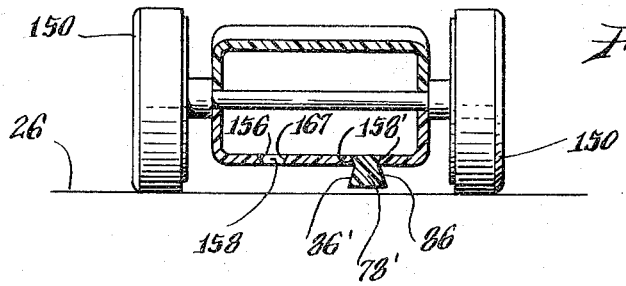

FIG. 18 is a section view of the toy vehicle racer and is taken along the line 18—18 in FIG. 17 to reveal the location of a guide element on the toy vehicle racer.

DETAILED DESCRIPTION OF PREFERRED EMBODIMENT

With reference to FIG. 1, a continuous toy vehicle race track 20 is perspectively shown formed of interconnected sections, some of which are curved, such as sections 22 (45° curve) and sections 23 (90° curve), and some of which are straight, such as sections 24. The track 20 has an unguided smooth racing surface 26 with a width W sufficient to enable toy vehicles 28—28′ to pass one another, at least on the curved track sections 22 and 23. The curved track sections 22 are steeply banked so the faster leading vehicle 28 stays to the outside of a turn, under the influence of centrifugal force, so as to pass the slower trailing vehicle 28′ which does not move as far to the outside of the curve as does the faster moving vehicle 28. Vehicles 28—28′ are self-propelled by spring drives, and operate at preferably the same maximum speed so that players' skills are needed to determine the outcome of a race. The track 20 is preferably laid out in the form of a closed loop arranged in an L, though different configuratios may be employed.

A chicane track section 30 is located in the path of the racing vehicles 28—28′ to impart a skill feature to the game. The term "chicane" is used in its broad sense as meaning an obstacle and not in the more restricted sense of being limited to a series of curves. The chicane includes slow-down devices 32—32′ which, when contacted by a vehicle, slow it to a very low speed. The slow-down devices 32—32′ may be momentarily disabled by the players, who control flexible pneumatic hand-grippable pumps 34—34′ which are operatively coupled to the slow-down elements through flexible tubes 36—36′.

In the vehicle racing game as shown in FIG. 1, each player controls his own vehicle. Thus the player controlling slow-down device 32 times his actuation for the instant his racing vehicle 28 is about to pass slow-down device 32. A vehicle diverter track section 38 is used to segregate the toy vehicles on the right-left basis corresponding to the location of the slow-down devices 32—32′. The vehicles are diverted with the aid of vehicle-mounted guide elements (not visible in the view of FIG. 1) and a guide splitter 40 selectively located on the roadbed surface 26 of the diverter 38. The guide splitter 40 is located in a narrow single-car-width corridor 39 formed by a constrictor guide 41. The guide splitter 40 cooperates with the guide element on the car 28 to direct that car to a guide 42 that leads to the slow-down device 32. The guide splitter 40 also cooperates with the guide element on the car 28′ to direct that car to a guide 42′ that leads to the slow-down device 32′.

It the player has properly judged the arrival of his vehicle, he will disable the slow-down device at just the right time to allow his vehicle to pass the chicane without a reduction of speed. If the player has misjudged the arrival time of his vehicle, it engages the slow-down device which retards the vehicle, permitting it to pass the chicane but at a much reduced speed.

The spring drives of the vehicles are so selected that they recover their speed slowly from the slow-down effect. As a result, a vehicle which passes the chicane without a speed reduction traverses the next curve 44 at a higher bank location, enabling the faster vehicle to pass the one slowed by the chicane.

Since the vehicles 28—28′ emerge on a right-left segregated basis from the chicane 30, a lap counter track section 46 is employed adjacent to the chicane 30 to register the number of laps traversed or to be traversed by each vehicle. The lap counter 46 includes separate counter indicators 48—48′ which register a new count each time a vehicle emerges from the chicane 30 and actuates a lever 50 or 50′. Levers 50—50′ are respectively coupled to advance lap counter indicators 48—48′.

In a typical race contemplated by the game of the invention, the lap counter indicators 48—48′ may be provided with a pre-set high number of laps-to-go, and the passage of each vehicle past the lap counter 46 causes a reduction of one of an indicator 48 or 48′. After completion of a predetermined maximum number of laps, determined by the stored energy in the wound-up springs, the vehicles must be removed to recharge their spring drives with "pit stop" spring wind-up devices 52—52′. In this manner a large number of laps may be raced to control the length of the racing game. A large number of "pit stops" may be required during the course of a race, so that the player's selection of the desired number of laps before the next "pit stop" is part of the strategy of the game. The spring wind-up devices 52 are preferably made in the manner described in a co-pending patent application Ser. No. 126,817 entitled "Spring Wind-Up Mechanism," filed by Burt Ensmann and Edwin Nielsen on the same date as this application and assigned to the same assignee as this invention.

Figures 2, 3, 4, 5, 6:
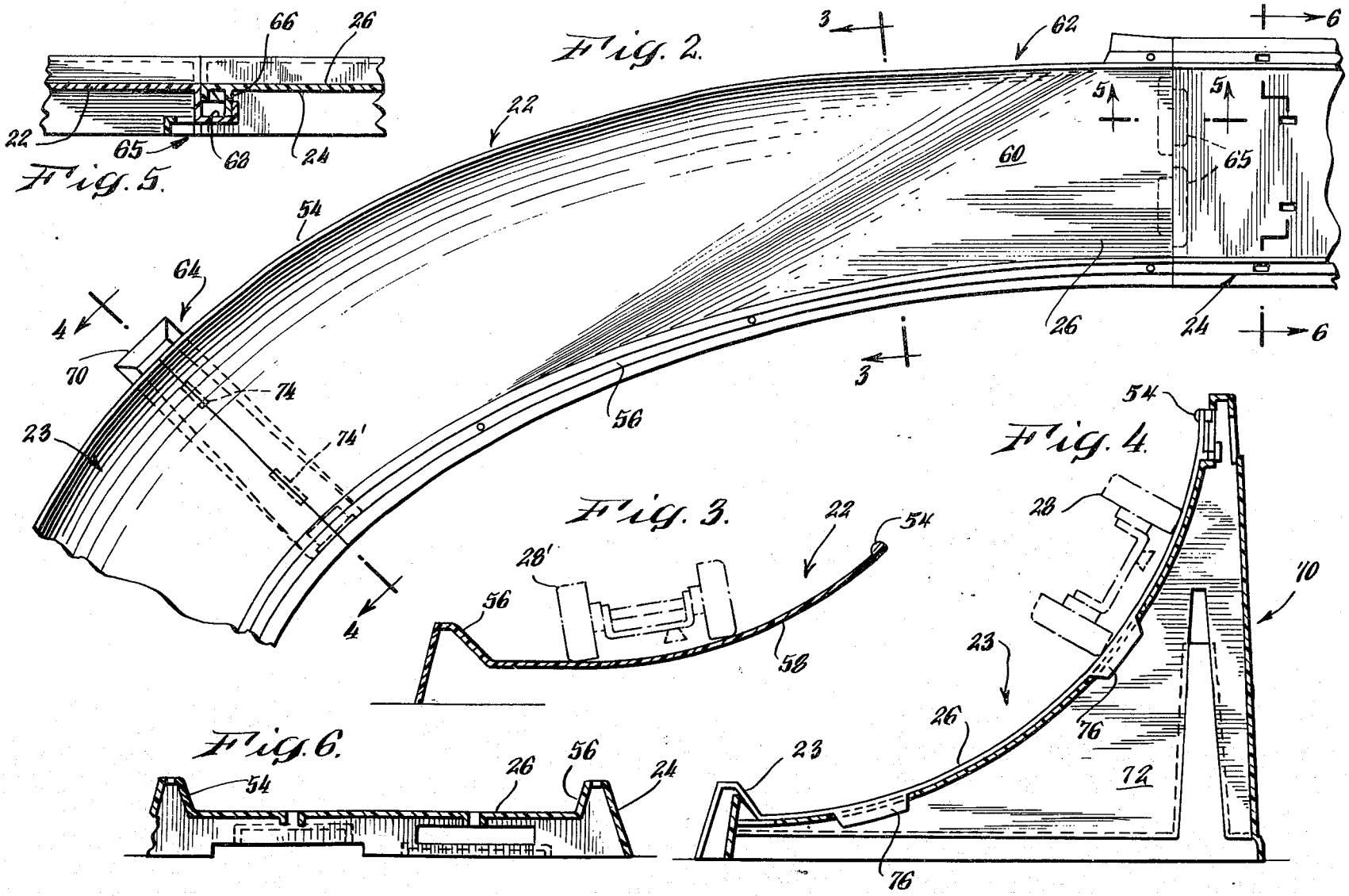
FIG. 2 is a plan view of a curved portion of the track shown in FIG. 1.
FIG. 3 is a section view of the curved track taken along the line 3—3 in FIG. 2.
FIG. 4 is a section view of the curved track taken along the line 4—4 in FIG. 2.
FIG. 5 is a partial section view taken along the line 5—5 in FIG. 2 illustrating the interconnection between a straight and a curved track section.
FIG. 6 is a section view of a flat, generally horizontal track section taken along the line 6—6 in FIG. 2.

Further details of the construction of the track 20 may be appreciated by reference to FIGS. 2 through 6. The curved track section 22 illustrated in FIG. 2 provides a 45° turn, as well as a roadbed transition from the straight track 24 to a banked curve. The track sections have an unguided roadway surface 26 except for lateral boundaries formed by an outer wall 54 and an inner wall 56. The roadway surface is generally flat and horizontally disposed over the straight track section 24, and gradually brought into a curved bank configuration 58 on the 45° track section 22 in the region generally indicated at 60. The bank 58 commences at an outer region 62 of the track section 22 and gradually widens until the entire track section is banked at end 64 as shown in the section view of FIG. 4. The bank curvature follows a circular segment whose radius is selected to provide a sufficiently wide roadway surface so that a faster vehicle such as 28 in FIG. 4 may move along the higher portion of the bank under the influence of centrifugal force, past a slower vehicle located near the inner wall 56 of the track section 22.

The curved track section 22 is connected to straight track section 24 by a pair of interlocks 65 each formed of a lip 66 and a groove 68 as illustrated in section in FIG. 5. A pair of interlocks 65 are employed laterally adjacent to one another to provide firm and stable connection between longitudinally aligned track sections.

The steeply banked end 64 of track section 22 is connected to 90° track section 23 by a support-connector 70 having a curved support wall 72 shaped to conform to the curvature of the banked ends of both the 45° track section 22 and the 90° track section 23. The wall 72 is provided with a pair of slots 74—74' which are sized to frictionally receive lips 76 depending from the ends of curved track sections 22 and 23. The 90° track section 23 has a banked cross-section, as shown in FIG. 4, throughout its entire length and matingly connects in similar fashion with another 45° curved track section 22 as shown in FIG. 1.

With reference to FIGS. 7, 9, 10 and 11, the diverter track section 38 is shown in greater detail. The constrictor 41 extends from the inner wall 56 (see FIG. 9) to define a corridor 39 which is just sufficiently wide to allow a single toy vehicle racer 28 to pass through. As can be seen from the views of FIGS. 9 and 11, each vehicle is provided with a guide rib 78 which depends from the bottom of the vehicle body between the wheels 80. The guide ribs 78 are so located laterally on the vehicles that the vehicle splitter 40 segregates the vehicles on a right-left basis, depending upon whether the vehicle guide ribs 78 contact surfaces 82 or 82' of the splitter 40.

The splitter surfaces 82—82' are inclined at acute angles of about 70° relative to the roadbed surface 26 (see also FIG. 9A), to form recesses 84—84' which can receive commplementary-shaped protruding segments 86 or 86' on the vehicle guide ribs 78. The engagement between the vehicle guide rib 78 and the splitter edges 82—82' advantageously produces both guiding and retention actions. Guide action depends upon lateral displacement of the splitter 40 relative to the plan view of FIG. 7. Retention action arises from the vertical capture by the inclined surfaces 82 of a protruding segment 86 on the guide rib 78, thus preventing bounce and escape of a vehicle 28 as it engages a guide surface 82 at high speed.

As shown in FIG. 7, splitter 40 is laterally shaped to guide the left-segregated vehicle 28' by means of surface 82' towards the slow-down device 32', and to guide the right-segregated vehicle 28 by means of surface 82 towards the slow-down device 32. The splitter 40 terminates at 90 to allow the right wheels of left vehicle 28' to cross over towards left guide 42', while the left wheels of the right-segregated vehicle 28 can cross over towards right guide 42. Wheel guide ribs 92—92' of rectangular cross-section are provided in the roadbed 26 (see FIG. 11) to maintain the proper directions of the segregated vehicles 28—28' respectively until the vehicle guide ribs 78—78' engage guides 42—42' respectively.

Vehicle guides 42—42' are provided with vehicle contacting surfaces 94—94' respectively which are inclined at acute angles relative to the roadbed surface 26 both to guide and to retain the vehicles 28—28' in the manner described for surfaces 82—82' on the splitter 40. Vehicle guides 42—42' are located to steer the vehicles 28—28' respectively to slow-down devices 32—32' on the chicane 30.

As can be seen from FIG. 7, the chicane 30 is formed as a segment of the track and includes pair of like-constructed actuator mechanisms 96—96' which respectively control the slow-down devices 32—32'. The slow-down devices (see FIG. 12) are each formed of a pair of longitudinally aligned facing brake elements 100–101 which are spaced from one another to frictionally receive therebetween the guide ribs 78 on the toy vehicles 28. The inner brake element 101 is stationary and projects upwardly from the roadbed 26 to contact a vehicle guide rib 78 along an inclined surface 101a. The outer brake element 100 is formed as an upwardly projecting lip on a movable brake plate 104. The brake element 100 has an inclined surface **100*a* which faces edge 101*a* so that the surfaces are opposable to exert a pinching brake action on a guide rib 78 passing between them. The slope of surfaces 101*a* and 100*a* is again such as to retain the car 28 vertically, and prevent it from bouncing off the roadbed upon engaging the brake device 32** at high speed.

The brake element 100 projects upwardly through a slot 106 in the road 26. The slot 106 is sufficiently wide to enable the brake element to extend at an acute angle with respect to the road bed 26, thereby to form recesses with the road bed, be moved away from the opposite brake element 101 and allow the vehicle guide rib 78 to pass unhindered between them. The brake plate 104 is supported on a raised segment 108 of a bottom plate 110. The brake plate 104 is pivotally mounted on the segment 108 by a pin 128 for pivotal motion about a vertical axis.

Movement of brake plate 104 is controlled by a bellows 112 which is pneumatically operated by a hand pump 34 shown in FIG. 1. The bellows is connected to the hand pump by flexible tubing 36. The bellows 112 is provided with a collar 114 to seat one end of the bellows fixedly in an aperture of frame 115 of the chicane 30. A bar 116 is integrally connected to the movable opposite end of the bellows, and is pivotally connected by a pin 118 to a lever 120. The bellows 112 is shown in its normal, contracted state in FIG. 12.

As illustrated in FIG. 13, the lever 120 is pivotally connected to the raised segment 108 of bottom frame 110 by a pin 121 so that expansion of the bellows in the direction of arrow 122 causes the tip 124 of lever 120 to engage a cam edge 126 on the brake plate 104. The brake plate 104 responds with a counter-clockwise movement about its pivot pin 128 to draw the brake element 100 away and open the chicane. This lets the vehicle 28 pass without a speed reduction, if done at the right moment.

A spring 130 is used to bias the brake plate 104 in a braking (clockwise) direction and is anchored to a torque link 132. Torque link 132 is pivotally mounted by a pin 134 on bottom plate 110, and may be rotated thereabout in the direction indicated by double-headed arrow 136 to successive index positions for an increase or decrease of spring bias. Torque link 132 has an extension 138 which engages one of several retaining edges 140 which are integrally formed on the bottom plate 110 and arcuately distributed about the pivot axis 134 of the torque link.

The selected retaining edge 140 serves to hold the torque link in a fixed position as the springs 130—130', which are connected to the brake plates 104—104', bias the torque link counterclockwise against the edge. Several retaining edges are provided so that an adjustment of spring tension may be obtained by placing the torque link to seat against different edges 140. The left brake mechanism 32' and actuating mechanism 96' are similarly constructed. Thus the brake plate 104' on the opposite side of the chicane 30 is correspondingly connected to the brake plate biasing spring 130' anchored to the torque link 132 at an anchor point which is on the opposite side of the pivot 134 relative to the anchor point for spring 130.

An advantageous feature of the chicane resides in its time-limited response to an actuation. This feature is obtained by providing bellows 112 with a bleed hole 142 which serves as an exit port from the pneumatic control pump for bleeding air away after actuation. Hence, upon squeezing of the hand pump 34, the bellows 112 is inflated and the hand pump temporarily remains compressed. Another actuation of the hand pump cannot be accomplished until the hand pump 34 has been allowed to resume its normal shape. Air for the return of the normal hand pump shape is obtained both from the bleedhole 142 and the now contracting bellows 112. The bellows 112 is blow-molded contracted and therefore provides a resilient restoring force which effectively tends to aid in the contraction of the bellows to its normal state when the hand pump is released. But if the player keeps the hand pump compressed in an effort to prolong the disabled time of the slow-down device, then the port 142 leaks air from the bellows and effectively limits the time of contact between the lever 120 and the brake plate 104. The dimensions of the bleedhole, the bellows and the hand pump are all selected so that the actuation of the brake plate 104 is of a duration which is just sufficient to allow a toy vehicle to pass unhindered through the chicane, provided the timing of the actuation is correct. In addition, the recovery time of the hand pump is sufficiently slow to prevent a player from putting together quick successive actuations to let his vehicle through the chicane. A player thus is given only a single try per lap to obtain a speed advantage over his opponent.

FIG. 14 illustrates the positions of the elements in the chicane during an actuation. The hand pump 34, which has been actuated (i.e., compressed), expanded the bellows 112 to cause the top edge 124 of the lever to engage the brake plate 104. The brake plate is then rotated counterclockwise against the spring bias, and pivots the brake element 100 away from the brake element 101. The space between the elements is thus increased to allow a vehicle guide rib 78 to freely pass between the brake elements. Note that, as shown in FIG. 14, expansion of the bellows is accompanied by a slight offset movement introduced by the pivot motion of the lever 120. The bellows is sufficiently flexible to accommodate this offset motion.

The bellows 112 is also aided in the resumption of its contracted state by the spring 130 which reactively presses the brake plate cam edge 126 against the tip 124 of the lever 120. The cam edge 126 is so oriented that its pressure against the lever tip 124 exerts a restoring force on the bellows to thus reduce the open time of the slow-down device 32. Link 132 may be used to control the braking force and open time of the slow-down device by selecting the tensions of springs 130—130′. Spring tensions are decreased or increased depending upon which retaining edge 140 is used to seat the torque link extension 138.

The springs 130—130′ further serve to provide a brake force on the vehicle-mounted guide ribs 78 in the event the slow-down elements 100—101 are not timely actuated, and the brake force is also varied by a spring tension adjustment using torque link 132. But even at the tightest setting, a vehicle whose guide rib encounters the brake element 100 will not be detained for long, since the brake plate 104 will yield sufficiently to allow the vehicle to pass, though at a much reduced speed.

The lap counter 46 is conveniently located adjacent to the chicane 30 to enable the segregated vehicles to actuate their respective levers 50 associated with lap indicators 48. As shown in FIGS. 7 and 8, the levers 50—50′, which are actuated by the guide ribs 78—78′ on the vehicles 28—28′ respectively as the vehicles pass by, are lips integrally attached to respective spring-loaded plates 133—133′ that operate conventional counter stepping mechanisms. The plates 133—133′ are pivotally mounted by pins 144—144′ on the underside of the track 24 and are resiliently biased by a spring 145 to urge the levers 50—50′ into position to be engaged by the guide ribs 78—78′ on the vehicles. The lap counters 46 may be set to the total number of laps in the race and allowed to decrease by one the counts registered by indicators 48 for each lap completed by a vehicle. Note that levers 50—50′ have oppositely slanted re-entrant surfaces **50*a* which mate with the correspondingly shaped surfaces of the vehicle guide ribs 78—78′** to defeat vehicle bounce when contact is made at high speed.

Another advantageous feature of the vehicle racing game of this invention resides in the use of spring-driven vehicles which are limited in their maximum travel range so that a number of pit stops (spring wind-ups) are required to complete a race consisting of the full number of laps called for by counters 46. FIG. 15 shows a toy racing vehicle 28 for use with the racing game of this invention. The vehicle is provided with front and rear wheels 150 and 152 respectively, and has its longitudinal guide rib 78 depending between the wheels and below the body of the vehicle 28. The vehicle guide rib 78 has a trapezoidal cross-sectional shape as shown in FIG. 18, with opositely located surfaces 86—86′ protruding at acute angles for engagement with suitable surfaces of the guides and brake elements located on the roadbed 26, as previously described. The guide rib, when mounted in a left-hand slot 158′ formed in the bottom wall of the body of the vehicle, makes it a left-hand vehicle as far as the left-right splitter 40 is concerned. The same guide rib, when mounted in a right-hand slot 158 of the same vehicle, has the opposite effect. Both slots 158—158′ have slanted edges 156—157 to receive a like-shaped upper portion of the guide rib 78.

As shown in FIGS. 16 and 17, the toy vehicle 28 includes a spring drive 160 which has an output drum 162 onto which a spring 164 is wound from a spring take-up drum 166 during "pit stop" winding. The drive 160 is largely conventional, and preferably of the substantially constant-torque-delivering type known by the name "Negator." A gear train 168 is provided to couple the output drum 162, on which the spring is wound during run-out, to the common axle 170 of the rear wheels 152. The gear train 168 is geared up (i.e., increased gear ratio) to provide low torque to the axle 170, so that the toy vehicle accelerates slowly after having been slowed by the chicane 30, but eventually reaches a high maximum speed if not slowed by the chicane. This accentuates the speed differential between the vehicles of players who are and those who are not skilled in using the chicane, and thus promotes the occurrence of vehicle passing situations as a reward for greater skill.

Vehicle distance limitations are imposed by means of a stop gear 172 which is coupled to a pinion 174 connected to the output drum 162. The stop gear 172 has an interference segment 176 in the form of a partially filled space between two teeth. In a presently preferred embodiment the stop gear 172 has 26 teeth and the pinion gear has 9 teeth. During wind-up the gear 172 and the pinion 174 rotate until one of the teeth of the pinion engages the segment 176. This provides a definite termination to the winding process. During the running of the vehicle, the gear 172 and the pinion rotate in directions opposite to their wind-up directions. After 9 revolutions of gear 172, the segment 176 provides sufficient interference with a tooth 174*a* on the pinion 174 to inhibit further rotation of the output drum 162. This interference operates two ways — during wind-up of the output drum 162, and during run-out. The gear ratio between pinion 174 and stop gear 172 is selected to determine the desired maximum vehicle travel distance. A spring motor utilizing an interference principle may be seen in U.S. Pat. No. 3,359,680 which is assigned to the assignee of the present invention.

Alternatively, the wind-up and run-out of the motor could be limited merely by the dimensions of the Negator spring itself; but this would risk damage due to over-winding of the spring at one extreme, and disassembly from the output drum at the other extreme. The described stop gear design incorporates wind-up and run-out limitations as a feature of the game, while precluding damage to the spring motor.

Strategic racing considerations are introduced into the game by this feature. Each player, knowing that his car will go only ten laps, for example, per wind-up, must decide when to bring his car in for a pit stop, depending upon whether the lost time will be more damaging now or later. In this respect, the game is quite strictly analogous to full-size racing, in which the number of laps in a race far exceeds the distance a race car can travel on a single fueling. The two lap counters of the present game emphasize this aspect by helping the players to keep track of their respective pit stop decisions.

One of the most exciting strategic decisions of this kind which a player may have to make occurs when the possible need for a pit stop arises near the end of a race. In full-size racing the question which arises under such circumstances is, will the car coast over the finish line if it runs out of fuel, or must it be refueled now even if that means yielding the lead at a critical moment? To make the present game similar to full-size racing in this respect as well, the vehicles are designed to coast to a gradual stop, rather than halting abruptly when the stop gear interference segment 176 takes effect. Various mechanisms for achieving this result are well known in the art. In the presently preferred embodiment of the invention, illustrated in the drawings, the interference gear 172 drives a pinion 174, and a gear 175 attached thereto, which drives a pinion 189 and a swing gear 177 secured thereto to form the drive train to a gear 179, a crown gear 181 secured thereto, and then to a pinion 183 which turns the rear wheel drive axle 170. The pinion 189 and swing gear 177 are mounted on a swing shaft 185 which rides a somewhat elongated journal slots 187 formed in the upper and lower walls of the vehicle chassis. The swing shaft 185 is thus movable in the slots, so that the pressure exerted on the swing gear 177 by rotation of gear 179 due to coasting of the car after the spring is unwound moves swing gear 177 and swing shaft 185 laterally, thus disengaging the gear 179 from swing gear 177 while gear 189 remains in engagement with gear 175. This effectively disconnects the rear wheel axle 170 from the Negator spring motor. Thus, at the moment when segment 176 is located to prevent further run-out of the spring, the momentum of the vehicle produces clockwise rotation of rear wheels 152 in the direction of arrow 200 (FIG. 17). This motion in turn causes axle pinion 183 to drive the crown gear 181 in a counter-clockwise direction (see arrow 202, FIG. 16). Hence gear 179 exerts a rotational force on swing gear 177 to move the swing shaft 185 to one end of the slot 187 and disengage swing gear 177 from gear 179. This permits the wheels 152 to spin freely so that the vehicle will coast. Powered rotation of gear 175 causes the swing gear 177 to re-engage gear 179.

The front vehicle wheels 150 are molded of a relatively smooth plastic material (preferably Celcon), while the rear wheels 152 are made of high friction material such as rubber to establish a friction difference between the front and rear wheels. This allows the front wheels 150 to slip slightly down the steeply banked curves of the track to aim the front of the vehicle into the turns (i.e., "oversteering") so that the outside passing maneuver does not degenerate into a centrifugal escape from the track. The desired friction difference is achieved when the curved track sections 22 and 23 are molded of polystyrene or a similar material. (For convenience, the straight track sections 24 are molded of the same material.)

Centrifugal escape is further prevented by the lateral curvature of the banked cross-section of the curved track sections 22 and 23. As seen in FIGS. 3 and 4, the cross-sectional curvature of track section 22 is substantially constant, i.e., circular, for convenience of manufacture. The cross-sectional curvature of track section 23 is also constant, but it has a smaller radius of curvature. In both cases, however, this cross-sectional curvature causes the bank angle encountered by a vehicle to increase at some rate (smaller for section 22, larger for section 23) as it rides further to the outside of a turn. The increase in bank angle results in an increase in several vehicle-retaining effects as the vehicle moves outside: first, the centripetal component of gravity is increased as the angle of inclination rises; second, the upper portion of the highly banked track begins to act as a retaining wall; and third, the increase in angle of inclination accentuates the tendency of the front of the vehicle to "fall" downhill relative to the rear, thus increasing the tendency of the vehicle to drive toward the inside of the turn. In effect, the vehicle's own motor is made to act increasingly as a centripetal agent.

The output drum 162 for winding of the spring is provided with a wind-up clutch driven member 178 which extends downwardly from the output drum as shown in FIGS. 15 and 17. The wind-up clutch 178 is formed with teeth 180 that are raked at re-entrant angles to form recesses 182 into which a correspondingly shaped wind-up clutch driving member 178' on a "pit stop" device 52 (See FIG. 1) may fit for winding of the spring 164. Further description of this wind-up feature is disclosed in the co-pending patent application, Ser. No. 126,817, entitled "Spring Wind-up Mechanism," filed by Burt Ensmann and Edwin Nielsen on the same date as this application, now U.S. Pat. No. 3,735,526 and assigned to the same assignee as this invention.

Conclusion

Having thus described a vehicle racing game and track in accordance with the invention, it will now be appreciated that each player must choose the game strategy he wishes to employ. The same maximum number of laps for the impeding race is dialed into the indicators 48—48' of the lap counter 46 (See FIG. 1) and the vehicles are wound and launched onto the track 20. As each vehicle is directed onto a chicane a player will time his hand pump actuation with the arrival of his vehicle over the slow-down device 32. If he has properly timed his actuation, his vehicle will race through the chicane, and may pass the opposing vehicle if it has been slowed by the chicane. Each time a vehicle passes the lap counter it clicks off a lap from indicator 48 by actuation of a lever 50. At various times, which the players can select within certain limits, each vehicle must be withdrawn to the player's "pit stop" 52 for rewinding of the vehicle spring. This continues until either vehicle first completes the preset number of laps.

Since the foregoing description and drawings are merely illustrative, the scope of protection of the invention has been more broadly stated in the following claims; and these should be liberally interpreted so as to obtain the benefit of all equivalents to which the invention is fairly entitled.

The embodiments of the invention in which an exclusive property or privilege is claimed are as follows:

1. A toy vehicle track segment comprising a vehicle racing surface and means on said segment for co-acting with a surface on a vehicle to brake the vehicle while retaining it vertically, said means including first and second elongated braking elements projecting upwardly from said racing surface, said first braking element having a vehicle contacting surface which is inclined at an acute angle relative to the vehicle racing surface to form therewith a recess to receive a complementary-shaped vehicle-mounted guide to direct toy vehicles traversing the vehicle racing surface while maintaining the toy vehicle in operative contact with the vehicle racing surface; said second braking element having a vehicle-contacting surface that is inclined at an acute angle to the vehicle racing surface, said contacting surfaces of said first and second braking elements being located in spaced opposed relationship to frictionally engage a vehicle-mounted guide therebetween, said second braking element being movably mounted to the track segment for braking movement towards and away from the first braking element to influence the speed of a toy vehicle whose guide passes between the first and second braking elements.

2. The toy vehicle track segment as in claim 1 further including means for momentarily actuating said second braking element to cause successive movements towards and away from the first braking element.

3. The toy vehicle track segment as in claim 2 wherein said momentary actuating means further includes:

a normally-contracted bellows operatively coupled to the second braking element to cause movement thereof in response to expansion of the bellows;

and means for pressurizing said bellows to cause expansion thereof.

4. The toy vehicle track segment as in claim 3 wherein said momentary actuating means further includes means effectively coupled to the bellows to spring bias said bellows to a contracted state.

5. The toy vehicle track segment as in claim 4 further including means for varying said spring bias to vary the braking force applied to said vehicle when frictionally engaged by said first and second braking elements.

6. The toy vehicle track segment as in claim 5 wherein said bellows has a bleed hole which is sized to cause recovery to the normally contracted state of the bellows over a predetermined period of time.

* * * * *